US011643906B2

(12) United States Patent
Patel

(10) Patent No.: US 11,643,906 B2
(45) Date of Patent: May 9, 2023

(54) SLIDING SLEEVE AND SPLIT SHIFTING TOOL

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 153 days.

(21) Appl. No.: 17/288,259

(22) PCT Filed: Oct. 25, 2019

(86) PCT No.: PCT/US2019/058115
§ 371 (c)(1),
(2) Date: Apr. 23, 2021

(87) PCT Pub. No.: WO2020/086986
PCT Pub. Date: Apr. 30, 2020

(65) Prior Publication Data

US 2021/0381340 A1 Dec. 9, 2021

Related U.S. Application Data

(60) Provisional application No. 62/751,504, filed on Oct. 26, 2018.

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS 1,889,806 A * 12/1932 Lamb ..... E21B 17/1085 175/325.7
4,051,899 A * 10/1977 Fredd ..... E21B 31/20 166/321

(Continued)

FOREIGN PATENT DOCUMENTS

WO 9634176 A2 10/1996
WO 2013003075 A2 1/2013

OTHER PUBLICATIONS

International Search Report and written opinion issued in PCT Application PCT/US2019/058115, dated Feb. 13, 2020 (10 pages).

(Continued)

*Primary Examiner* — Taras P Bemko
(74) *Attorney, Agent, or Firm* — Jeffrey D. Frantz

(57) ABSTRACT

A system includes a sliding sleeve valve including a valve body and an inner sleeve selectively shiftable within the valve body, at least one flow port contained in the valve body, at least one metal to metal seal provided between an inside wall of the valve body and the inner sleeve, and a shifting tool. The inner sleeve of the sliding sleeve valve includes a plurality of selective profiles, and the shifting tool is engageable with the plurality of selective profiles of the inner sleeve. The shifting tool includes two halves that each include a recess for accommodating a plurality of control lines.

11 Claims, 18 Drawing Sheets

(56) References Cited

U.S. PATENT DOCUMENTS 4,436,152 A * 3/1984 Fisher, Jr. ..... E21B 23/08 166/382
5,810,100 A * 9/1998 Samford ..... E21B 17/1064 166/241.6
6,032,748 A * 3/2000 DeBray ..... E21B 17/105 175/325.1
6,631,768 B2 10/2003 Patel et al.
7,938,202 B2 * 5/2011 Mitchell ..... E21B 17/105 166/241.6
8,141,648 B2 3/2012 Darnell et al.
8,646,533 B2 2/2014 Nguy et al.
8,869,903 B2 * 10/2014 Thomas ..... E21B 43/14 166/177.5
9,115,546 B2 * 8/2015 Howlett ..... E21B 17/1064
11,352,840 B2 * 6/2022 Smith ..... E21B 17/16
2005/0072577 A1 * 4/2005 Freeman ..... E21B 34/14 166/66.4
2009/0071655 A1 3/2009 Fay
2011/0114325 A1 * 5/2011 Coghill ..... E21B 34/14 166/332.3
2013/0233565 A1 * 9/2013 Turick ..... E21B 34/103 166/373
2014/0000900 A1 * 1/2014 Leiper ..... E21B 17/006 166/173
2014/0345876 A1 11/2014 Coon et al.
2015/0308228 A1 * 10/2015 Vick, Jr. ..... E21B 34/12 166/334.1
2016/0215581 A1 7/2016 Ingraham et al.
2016/0251898 A1 * 9/2016 Angman ..... E21B 17/1078 175/57
2018/0163486 A1 * 6/2018 Davies ..... E21B 23/01

OTHER PUBLICATIONS

International Preliminary Report on Patentability issued in PCT Application PCT/US2019/058115, dated May 6, 2021, 7 pages.

* cited by examiner

SLIDING SLEEVE AND SPLIT SHIFTING TOOL

CROSS-REFERENCE TO RELATED APPLICATION

The present document is based on and claims priority to U.S. Provisional Application Ser. No. 62/751,504, filed Oct. 26, 2018, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in an around the wellbore for conveying, pumping, or controlling the production or injection of fluids.

While completing a well or performing subsequent remedial work, downhole tools requiring mechanical actuation are often used. The mechanical actuation can be used to perform numerous types of actions, for example, setting or releasing a downhole tool or reconfiguring a tool, such as opening or closing a valve.

Sliding sleeves and shifting tools of various kinds are commonly used in the industry and known to those skilled in the art. In general, a sliding sleeve is a communication device that provides a flow path between a production conduit and a surrounding annulus downhole. In particular, a sliding sleeve valve may be used to control fluid flow between the production conduit and the surrounding annulus during production. A shifting tool may be used to shift the sliding sleeve or the sliding sleeve valve between closed and open positions. Control lines may be deployed along the completion to facilitate actuation of the sliding sleeve or the sliding sleeve valve in cooperation with the shifting tool. However, when multiple control lines are employed, splicing several control lines together may introduce weak points that are susceptible to corrosion, shorting, leakage, control line damage, and other deleterious effects.

SUMMARY

One or more embodiments of the present disclosure is directed to a system that includes a sliding sleeve valve including a valve body and an inner sleeve selectively shiftable within the valve body, at least one flow port contained in the valve body, at least one metal to metal seal provided between an inside wall of the valve body and the inner sleeve, wherein the inner sleeve includes a plurality of selective profiles, and a shifting tool engageable with the plurality of selective profiles of the inner sleeve, wherein the shifting tool comprises two halves that each include a recess for accommodating a plurality of control lines.

According to one or more embodiments of the present disclosure, a device includes a first half, a second half, wherein the first half and the second half are disposed around a tubing and fastened together creating a central bore, wherein at least one of the first half and the second half includes a recess for accommodating a plurality of control lines, and at least one collet configured to engage a selective profile of an inner sleeve of a sliding sleeve valve.

One or more embodiments of the present disclosure is directed to a method including running a sliding sleeve valve downhole in a closed position, wherein the sliding sleeve valve includes: a valve body, an inner sleeve selectively shiftable within the valve body, at least one flow port contained in the valve body, and at least one metal to metal seal provided between an inside wall of the valve body and the inner sleeve, wherein the inner sleeve includes an opening selective profile and a closing selective profile, operating a shifting tool to engage with the opening selective profile of the inner sleeve of the sliding sleeve valve, wherein the shifting tool includes two halves that each include a recess for accommodating a plurality of control lines, shifting the inner sleeve of the sliding sleeve valve until the sliding sleeve valve transitions from the closed position to an open position in which the at least one flow port is uncovered, disengaging the shifting tool from the opening selective profile of the inner sleeve of the sliding sleeve valve, operating the shifting tool to engage with the closing selective profile of the inner sleeve of the sliding sleeve valve, operating the shifting tool to engage with the closing selective profile of the inner sleeve of the sliding sleeve valve, shifting the inner sleeve of the sliding sleeve valve until the sliding sleeve valve transitions from the open position back to the closed position, and retrieving the shifting tool from downhole until the shifting tool disengages from the closing selective profile of the inner sleeve of the sliding sleeve valve.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The present disclosure generally relates to a system and methodology for operating a sliding sleeve valve using a split shifting tool. Because the shifting tool adopts a split configuration that may accommodate control line flat packs, it is not necessary to splice together multiple control lines that may be deployed along the completion for actuation of the sliding sleeve or the sliding sleeve valve in cooperation with the shifting tool. Advantageously, the splice-free control lines reduce the potential for corrosion, shorting, leakage, control line damage, and other deleterious effects that could occur at splice points.

Figure 1:
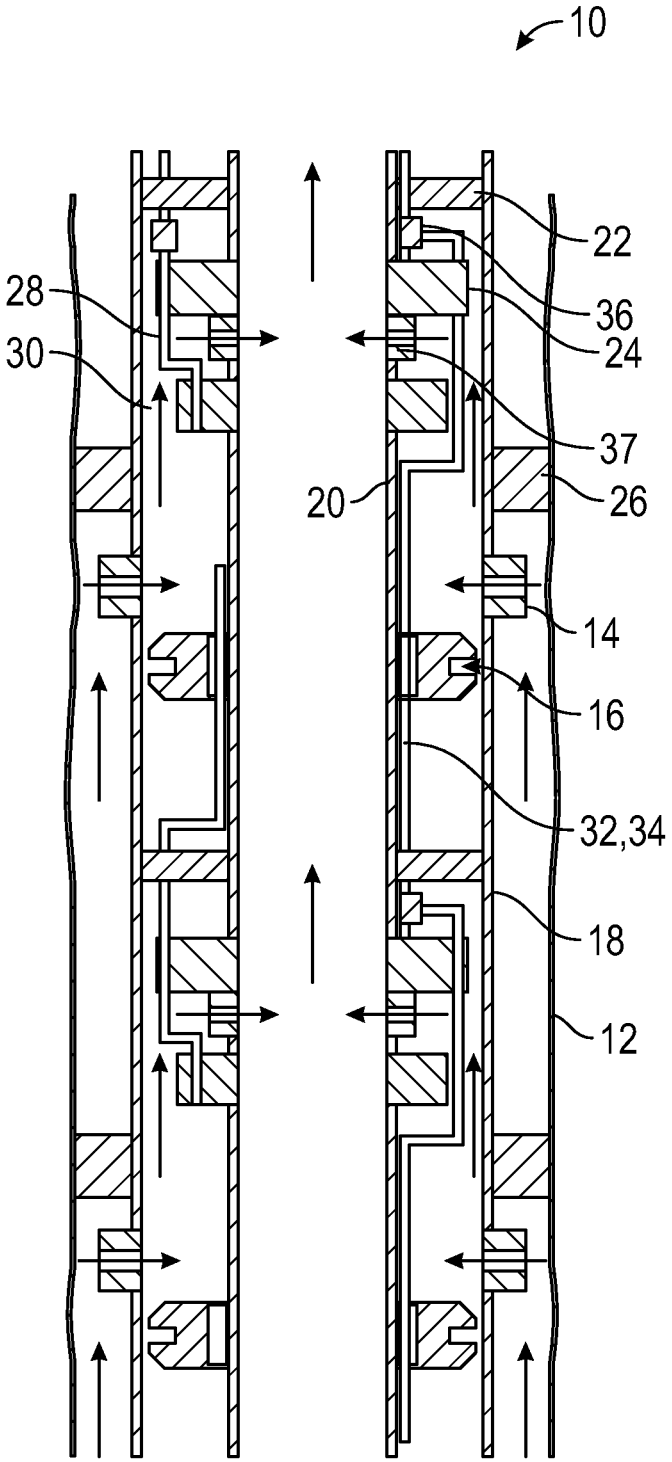
FIG. 1 is a schematic illustration of a completion having a sliding sleeve valve and a split shifting tool deployed in a wellbore, according to an embodiment of the disclosure.

Referring generally to FIG. 1, a schematic illustration of a completion 10 deployed in a wellbore 12 is shown. In this embodiment, the completion 10 includes a sliding sleeve valve 14 with a selective profile and a split shifting tool 16 with a corresponding selective profile to open and close the sliding sleeve valve 14. As shown, the sliding sleeve valve 14 may be disposed on a liner 18 of the completion 10, and the split shifting tool 16 may be disposed on a production tubing 20 of the completion 10. The completion 10 may include other components such as a feed through packer 22, a flow control valve 24, an open hole zonal isolation packer 26, a chemical injection line 28, a chemical injection mandrel 30, and mechanical sliding sleeve valve 37, for example. In this particular embodiment, the completion 10 also includes several hydraulic control lines 32 and an electronic cable 34, for example. As shown in FIG. 1, and as further described below, the split shifting tool 16 is able to accommodate multiple hydraulic control lines 32 and electronic cables 34 in the area of the completion 10 where the split shifting tool 16 is disposed without having to splice together the multiple control lines 32 and cables 34. In contrast, in the area of the completion 10 where the split shifting tool 16 is not disposed, an electrical and hydraulic splice 36 is needed to splice together the multiple hydraulic control lines 32 and electronic cables 34.

Figure 2:
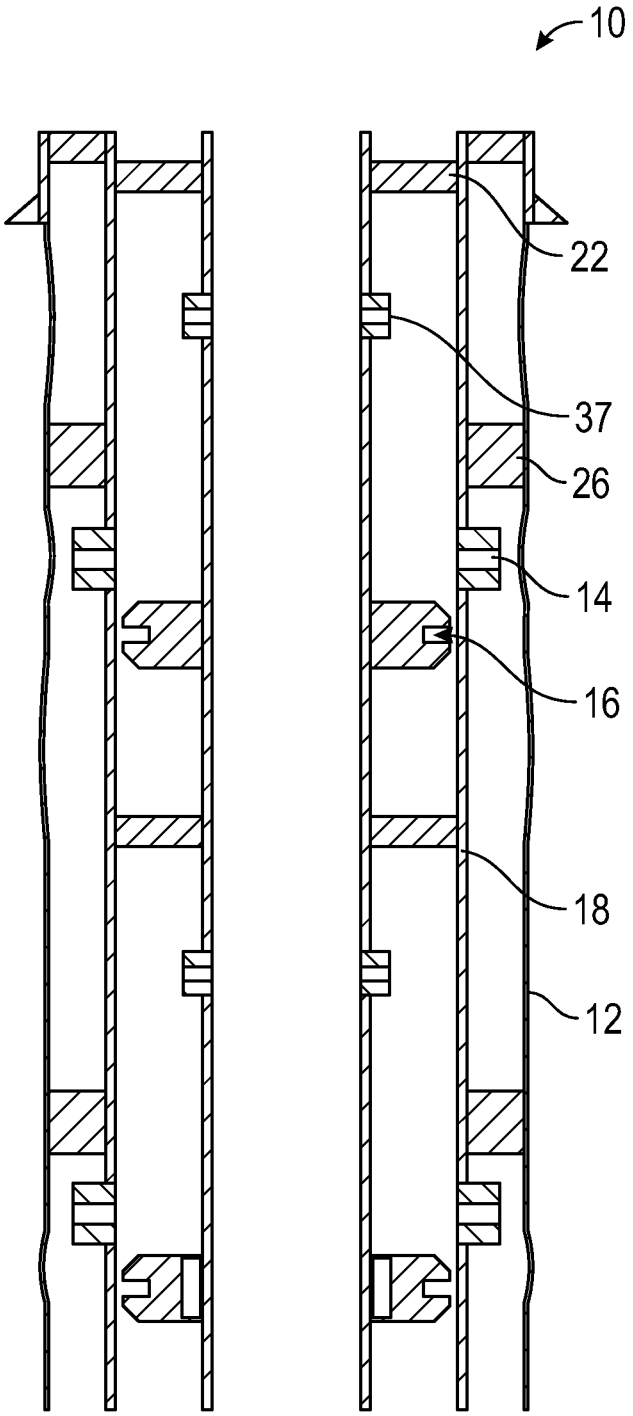
FIG. 2 is the schematic illustration of a completion similar to FIG. 1, but with an inner tool including control lines and injection lines removed, according to an embodiment of the disclosure.

Referring now to FIG. 2, a schematic illustration of a completion 10 similar to FIG. 1, but with an inner tool including control lines and injection lines removed, is shown for additional clarity. As shown, there is one split shifting tool 16 having a selective profile for each sliding sleeve valve 14 having a corresponding selective profile, according to one or more embodiments of the present disclosure.

Figure 3:
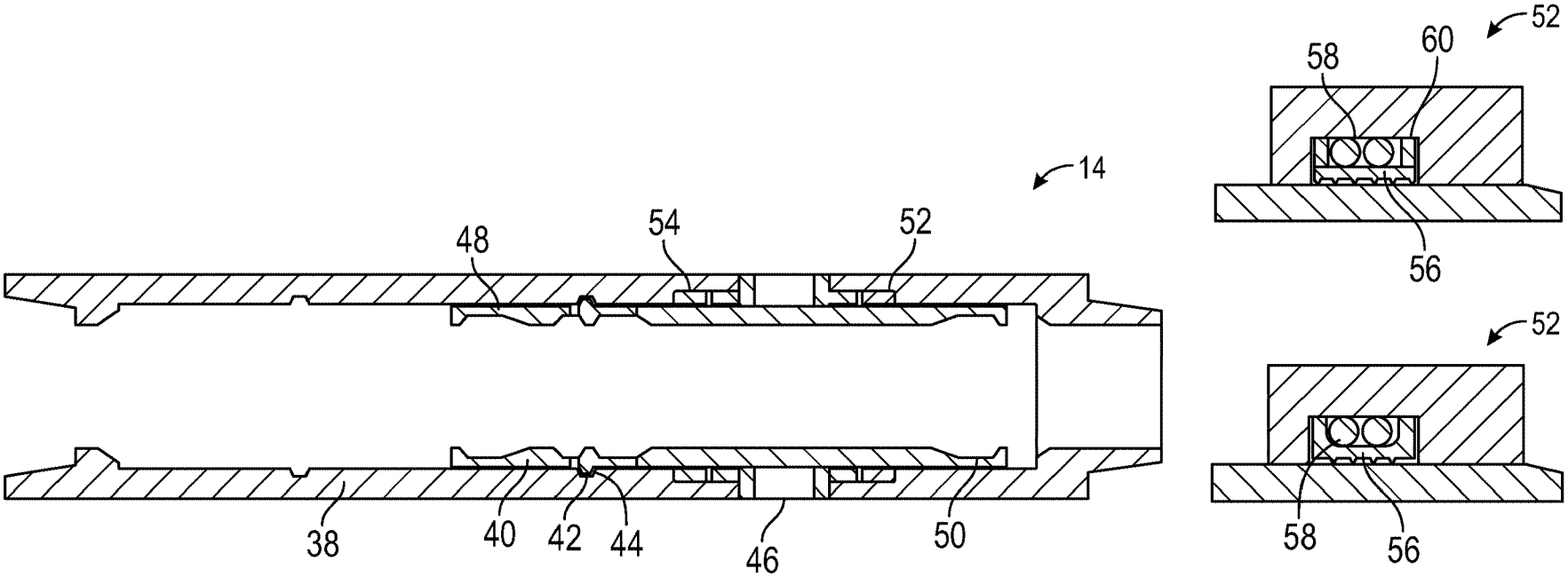
FIG. 3 is a schematic illustration of an example of a sliding sleeve valve, according to an embodiment of the disclosure.

Referring now to FIG. 3, a schematic illustration of an example of a sliding sleeve valve 14 according to an embodiment of the present disclosure is shown. As shown, the sliding sleeve valve 14 includes a valve body 38 and an inner sleeve 40. A position holding collet 42 on the inner sleeve 40 of the sliding sleeve valve 14 engages a shoulder 44 of the valve body 38 and holds the position of the inner sleeve 40 with respect to the valve body 38. According to one or more embodiments of the disclosure, the inner sleeve 40 may be selectively shifted to either permit or block fluid flow through the flow ports 46 in the valve body 38. As shown in the example of FIG. 3, the inner sleeve 40 is shifted over the flow ports 46 in the valve body 38 to block fluid flow through the flow ports 46. As such, the sliding sleeve valve 14 shown in FIG. 3 is in a closed, run-in-hole position. As further shown, the inner sleeve 40 includes an opening selective profile 48 for engagement with a corresponding selective profile of a split shifting tool 16, and a closing selective profile 50 for engagement with a corresponding selective profile of the split shifting tool 16, according to one or more embodiments of the disclosure.

Still referring to FIG. 3, seals are provided between the inside wall of the valve body 38 and the inner sleeve 40 to prevent fluid bypass when the valve is closed. For example, at least a metal to metal unloading seal 52 is provided in accordance with one or more embodiments of the present disclosure. An additional non-elastomeric seal 54 may also be provided. As further shown in FIG. 3, the metal to metal unloading seal 52 may include a metal ring 56 made of aluminum and/or bronze in accordance with one or more embodiments of the present disclosure. The metal ring 56 used in the metal to metal unloading seal 52 may be of the close tolerance type or may provide a small interference fit. In one or more embodiments, O-rings or Metal Spring Energized (MSE) seals 58 may be employed in the metal to metal unloading seal 52 as shown in FIG. 3. In some embodiments a back-up ring 60 may be used in the metal to metal unloading seal 52 to prevent extrusion of the O-rings or MSE seals 58, for example. The back-up ring 60 may be made of polyetheretherketone (PEEK) or another thermoplastic material, for example.

Figure 4:
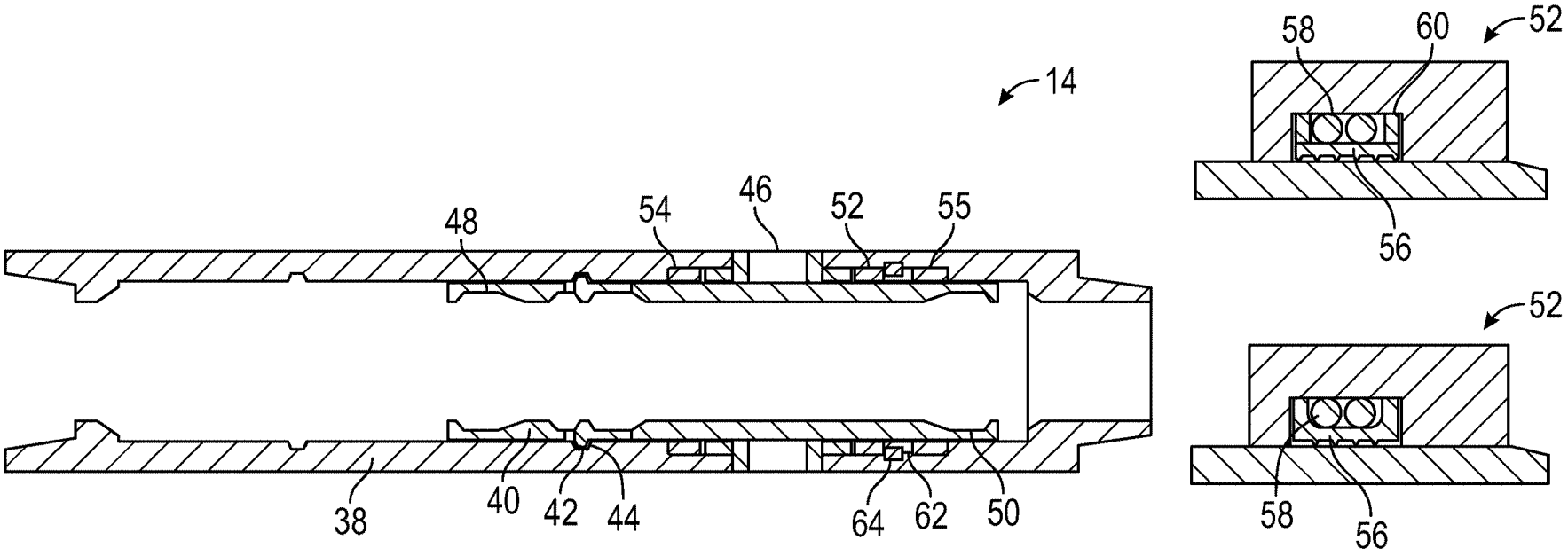
FIG. 4 is a schematic illustration of an example of a sliding sleeve valve similar to that of FIG. 3, but with a different seal configuration, according to an embodiment of the disclosure.

Referring now to FIG. 4, a schematic illustration of an example of a sliding sleeve valve 14 similar to that of FIG. 3, but with a different seal configuration, is shown according to one or more embodiments of the present disclosure. Specifically, FIG. 4 shows a combination of a full support sleeve 62 and a split ring 64 provided between the metal to metal unloading seal 52 and a second non-elastomeric seal 55, according to one or more embodiments of the present disclosure. As shown in FIG. 4, each of the first non-elastomeric seal 54, the metal to metal unloading seal 52, the combination of the full support sleeve 62 and the split ring 64, and the second non-elastomeric seal 55 are provided between the inside wall of the valve body 38 and the inner sleeve 40 of the sliding sleeve valve 14. Advantageously, due to this seal configuration, at least the second non-elastomeric seal 55 can provide sealing at lower pressures while the metal to metal unloading seal 52 may help to prevent blowouts.

Figure 5:
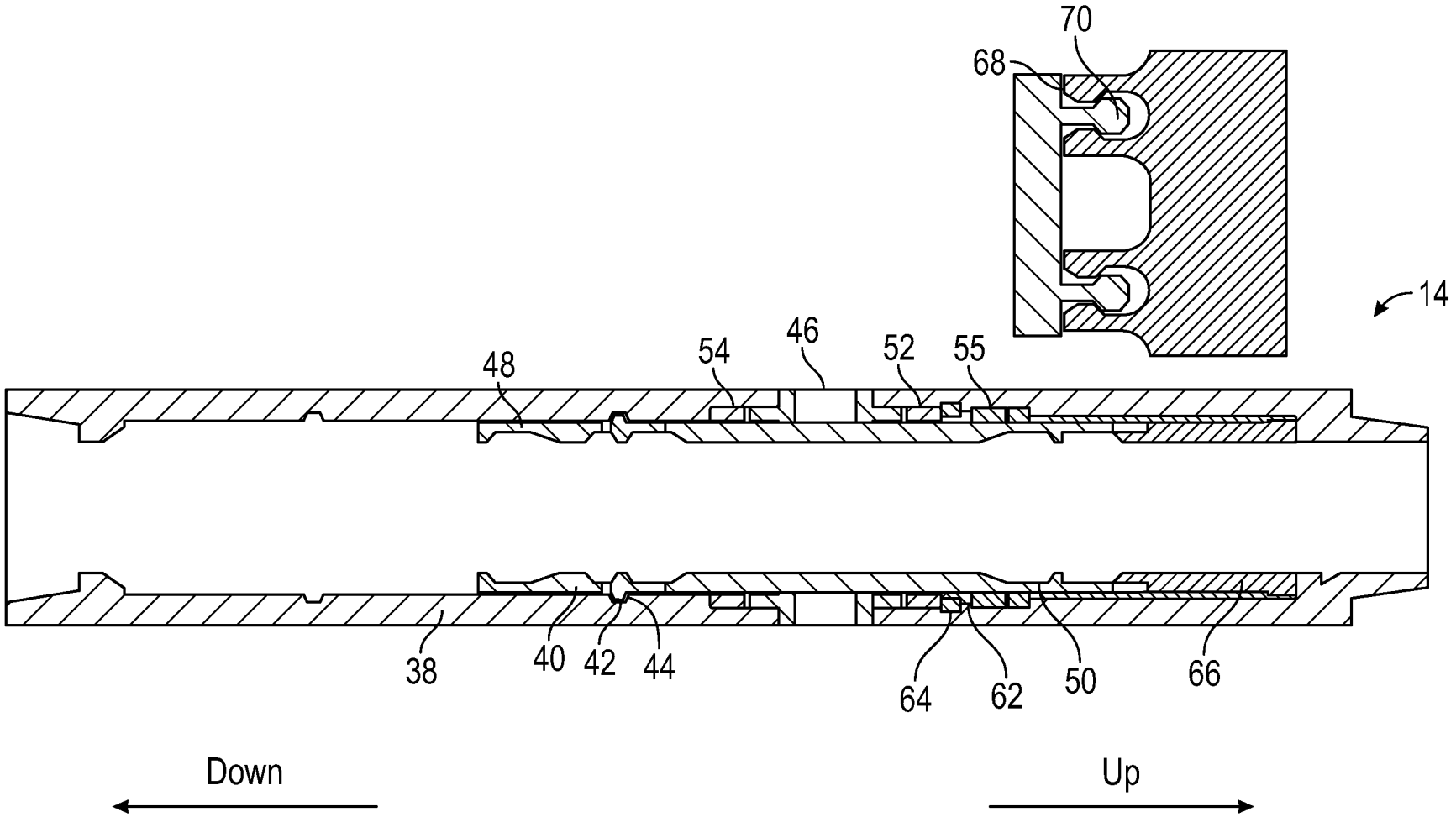
FIG. 5 is a schematic illustration of an example of a sliding sleeve valve, according to an embodiment of the disclosure.
Figure 6:
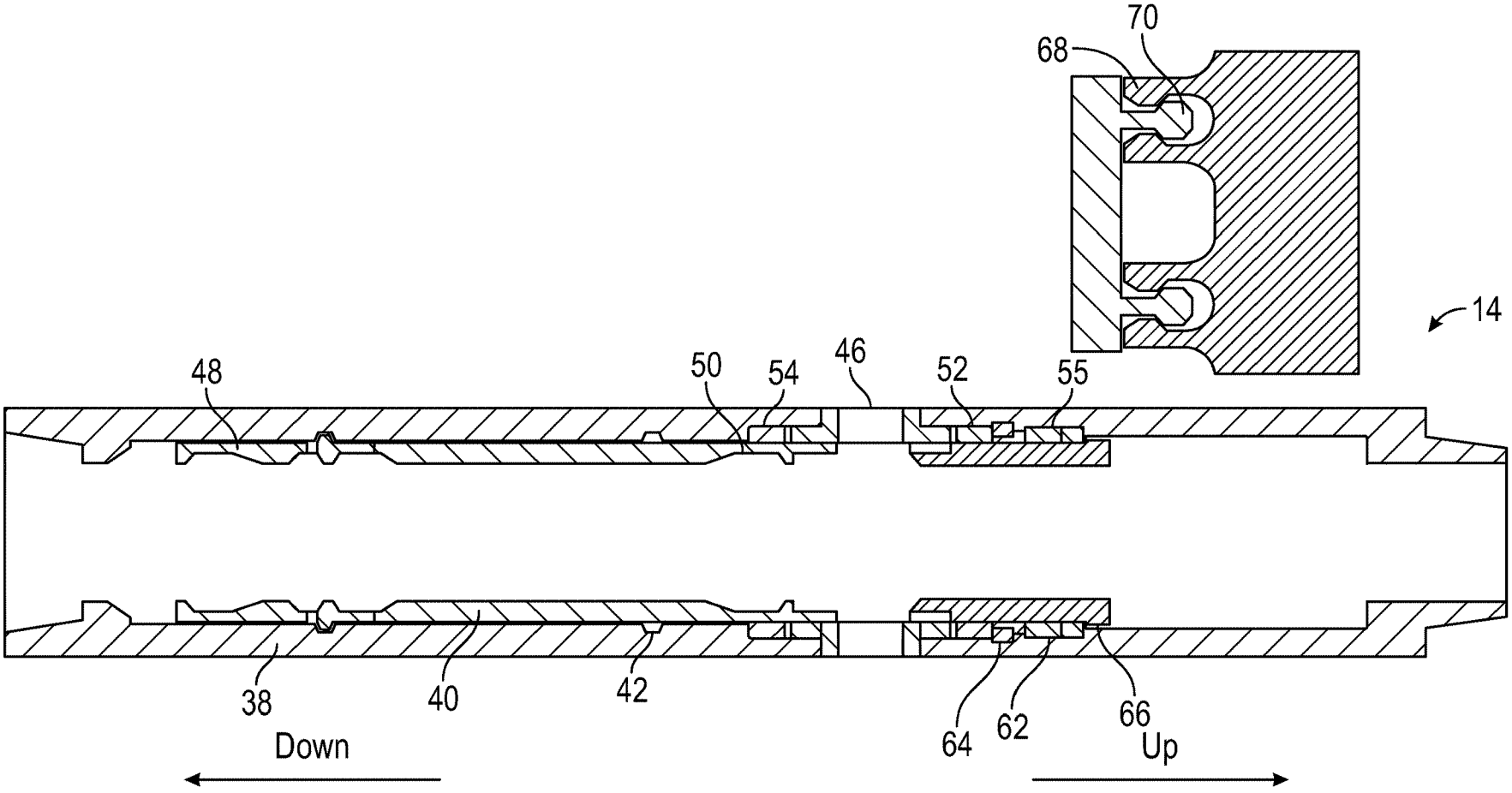
FIG. 6 is a schematic illustration of an example of a sliding sleeve valve similar to that of FIG. 5, but during a different operational stage, according to an embodiment of the disclosure.

Referring now to FIGS. 5 and 6, a schematic illustration of another example of a sliding sleeve valve 14 according to an embodiment of the disclosure is shown. Specifically, FIG. 5 shows the sliding sleeve valve 14 in a closed, run-in-hole position, and FIG. 6 shows the sliding sleeve valve 14 in an open position. According to one or more embodiments, a split shifting tool 16 (not shown) cooperates with the closing selective profile 50 of the sliding sleeve valve 14 to shift the sliding sleeve valve 14 to the closed position, and cooperates with the opening selective profile 48 of the sliding sleeve valve 14 to shift the sliding sleeve valve 14 to the open position.

Still referring to FIGS. 5 and 6, the combination of the full support sleeve 62 and the split ring 64 is provided between the metal to metal unloading seal 52 and the second non-elastomeric seal 55, as previously described with respect to FIG. 4. As further shown in FIGS. 5 and 6, a protector sleeve 66 may be provided to protect at least the metal to metal unloading seal 52, the combination of the full support sleeve 62 and the split ring 64, and the second non-elastomeric seal 55, in accordance with one or more embodiments of the present disclosure. As shown in FIG. 5, for example, a downhole end of the protector sleeve 66 may include a plurality of collets 68 for releasably holding one or more protrusions 70 on an uphole end of the inner sleeve 40 of the sliding sleeve valve 14 when the sliding sleeve valve 14 is in the closed position. Advantageously, this collet configuration provides a more cost-effective and robust solution than corresponding conventional configurations that utilize a spring. As further shown in FIG. 5, the inner sleeve 40 of the sliding sleeve valve 14 protects at least the metal to metal unloading seal 52, the combination of the full support sleeve 62 and the split ring 64, and the second non-elastomeric seal 55, when the sliding sleeve valve 14 is in the closed position. Referring now to FIG. 6, when a split shifting tool 16 (not shown) cooperates with the opening selective profile 48 of the sliding sleeve valve 14 to shift the sliding sleeve valve 14 to the open position, the inner sleeve 40 and the seal protector sleeve 66 move down until the protector sleeve 66 is protecting at least the metal to metal unloading seal, the combination of the full support sleeve and the split ring, and the second non-elastomeric seal 52, and the plurality of collets 68 of the seal protector sleeve 66 releases the one or more protrusions 70 on the uphole end of the inner sleeve 40 of the sliding sleeve valve 14. In this way, the seal configuration of the sliding sleeve valve 14 according to one or more embodiments of the present disclosure may be protected by the protector sleeve 66 during production when the sliding sleeve valve 14 is in the open position.

Figures 7A, 7B:
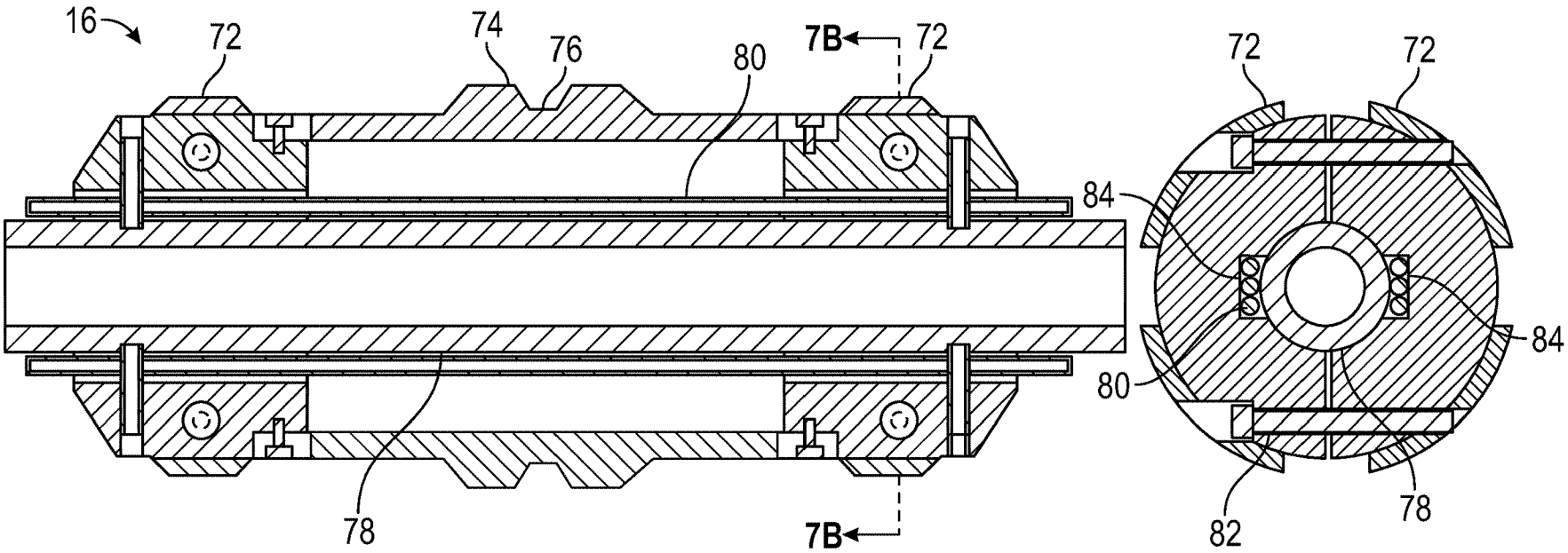
FIG. 7A is a partial cross-section of an example of a split shifting tool, according to an embodiment of the disclosure.
FIG. 7B is a top view of the example of the split shifting tool of FIG. 7A, taken along line 7B-7B, according to an embodiment of the disclosure.

Referring now to FIG. 7A, a partial cross-section of an example of a split shifting tool 16 is shown, according to one or more embodiments of the present disclosure. As shown, the split shifting tool 16 includes at least one fluted centralizer 72, a collet 74, a selective profile 76 corresponding to a selective profile of a sliding sleeve valve 14, and a pup joint 78 having a bore therethrough according to one or more embodiments of the disclosure. As also shown in FIG. 7A, the split shifting tool 16 accommodates a control line flat pack 80. Depending on the specific application, the control lines may include electrical cables or a variety of other control lines including hydraulic control lines, optical fiber control lines, and other control lines. The control lines may also include hybrid control lines providing various combinations of electrical, hydraulic, optical, and/or other control lines.

Referring now to FIG. 7B, a top view of the example of the split shifting tool 16 of FIG. 7A taken along line 7B-7B is shown, according to one or more embodiments of the present disclosure. As shown more clearly in FIG. 7B, the two half-fluted centralizers 72 contribute to the split design of the split shifting tool 16. As shown, the two half-fluted centralizers 72 may be bolted together with a type of fastener 82. Further, each half-fluted centralizer 72 includes a recess 84 arranged along a portion of the circumference of the pup joint 78 for accommodating the control line flat pack 80, according to one or more embodiments of the present disclosure. Due to this split design of the split shifting tool 16, in accordance with one or more embodiments of the present disclosure, splicing together multiple control lines may be avoided. Although two fasteners 82 are shown in the view of FIG. 7B, this number is not limiting, and other amounts of fasteners 82 are within the scope of the present disclosure.

Figures 8A, 8B:
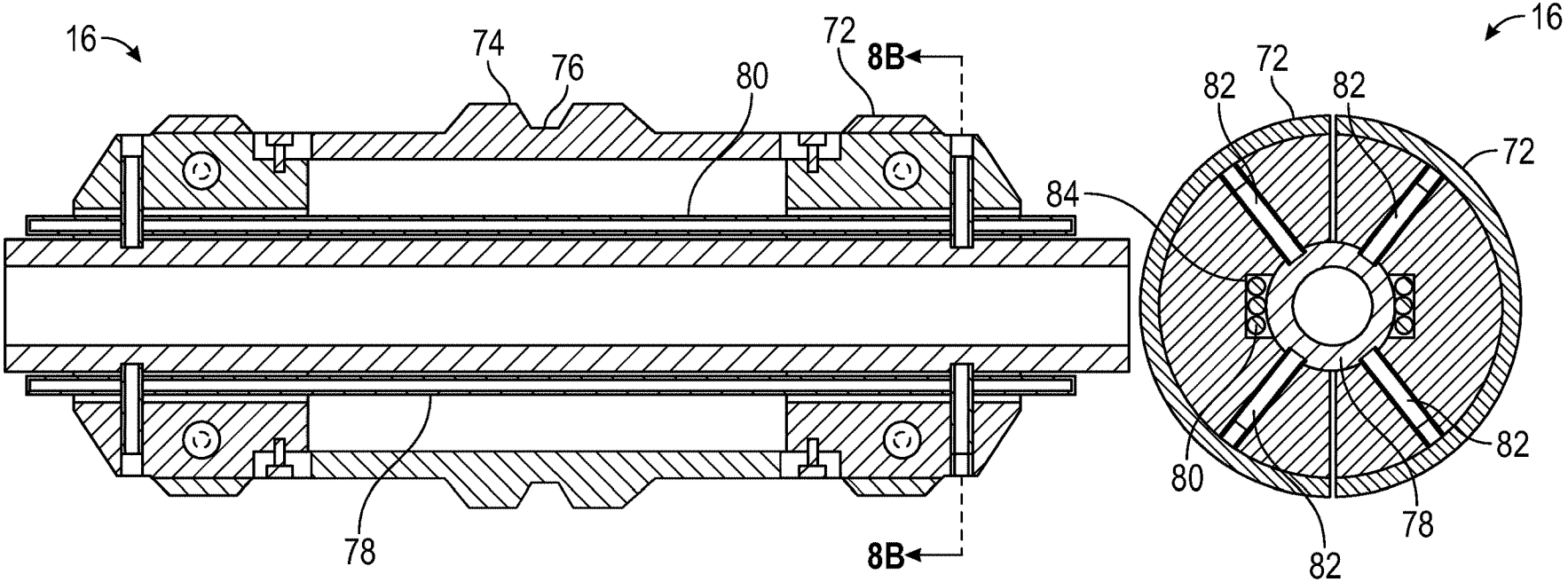
FIG. 8A is a partial cross-section of an example of a split shifting tool, according to an embodiment of the disclosure.
FIG. 8B is a top view of the example of the split shifting tool of FIG. 8A, taken along line 8B-8B, according to an embodiment of the disclosure.

Referring now to FIG. 8A, a partial cross-section of an example of a split shifting tool 16, according to one or more embodiments of the present disclosure is shown. Specifically, FIG. 8A shows the split shifting tool 16 having the same components as described with respect to FIG. 7A above. FIG. 8B is a top view of the example of the split shifting tool 16 of FIG. 8A taken along line 8B-8B, according to one or more embodiments of the present disclosure. From the view of FIG. 8B, four additional screws, bolts, or other types of fasteners 82 may be seen disposed around the perimeter of the pup joint 78 or tubing. According to one or more embodiments of the present disclosure, the additional screws 82 disposed around the perimeter of the pup joint 78 or tubing prevent axial and rotational movement of the split shifting tool 16. That is, the additional screws allow the split shifting tool to be fixed to the tubing and prevent undesired cutting of or other damage to the control lines. Although four additional screws 82 are shown in FIG. 8B, this number is not limiting, and other amounts of additional screws 82 or other types of fasteners are within the scope of the present disclosure.

Figure 9B:
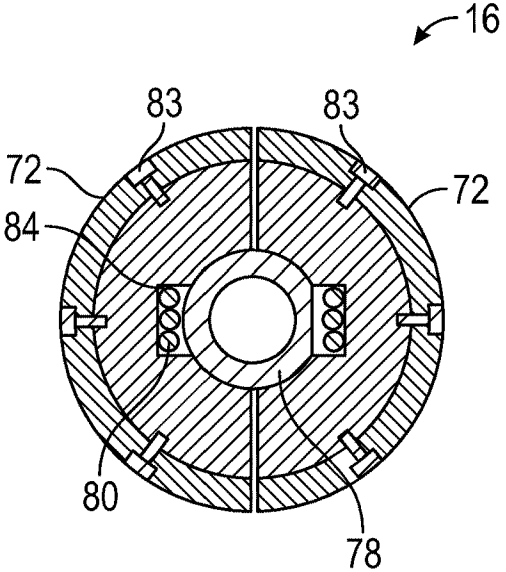
FIG. 9B is a top view of the example of the split shifting tool of FIG. 9A, taken along line 9B-9B, according to an embodiment of the disclosure.
Figure 9A:
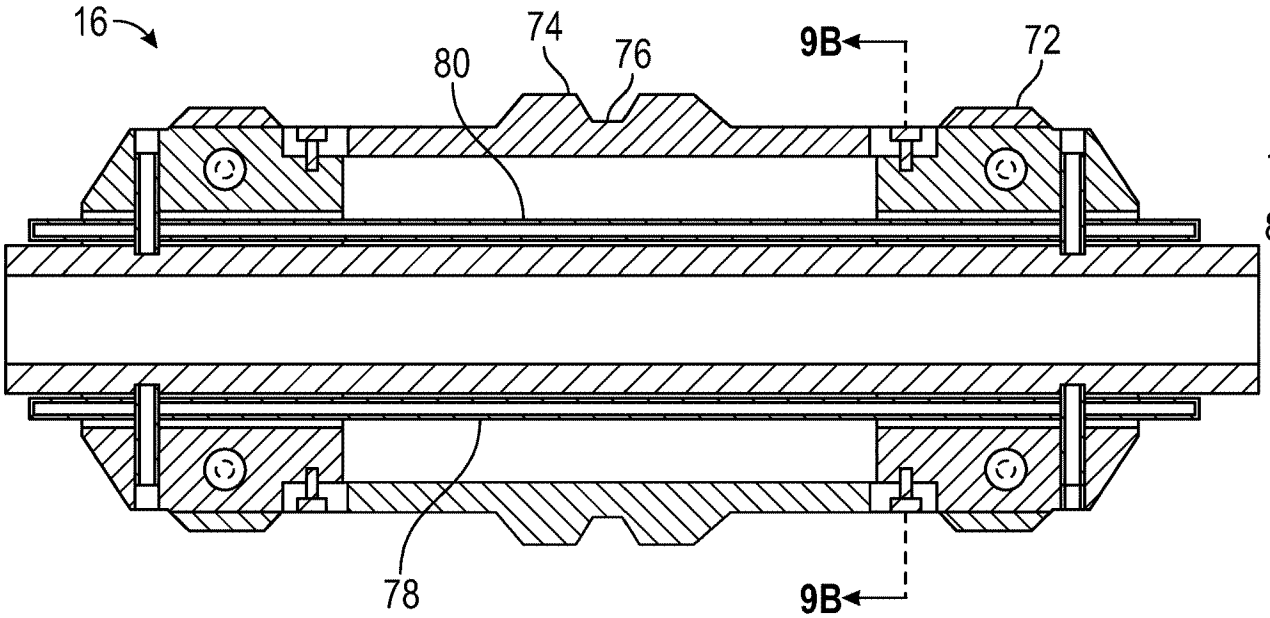
FIG. 9A is a partial cross-section of an example of a split shifting tool, according to an embodiment of the disclosure.

Referring now to FIG. 9A, a partial cross-section of an example of a split shifting tool, according to one or more embodiments of the present disclosure is shown. Specifically, FIG. 9A shows the split shifting tool 16 having the same components as described with respect to FIG. 7A above. FIG. 9B is a top view of the example of the split shifting tool of FIG. 9A taken along line 9-9, according to one or more embodiments of the present disclosure. From the view of FIG. 9B, three additional screws 83, bolts, or other types of fasteners may be seen disposed around the perimeter of each of the two half-fluted centralizers 72. According to one or more embodiments of the present disclosure, these additional screws 83 help to clamp the two half-fluted centralizers 72 to a mechanical structure. Although a total of six additional screws 83 are shown in FIG. 9B, this number is not limiting, and other amounts of additional screws 83 or other types of fasteners are within the scope of the present disclosure.

Figures 10A, 10B:
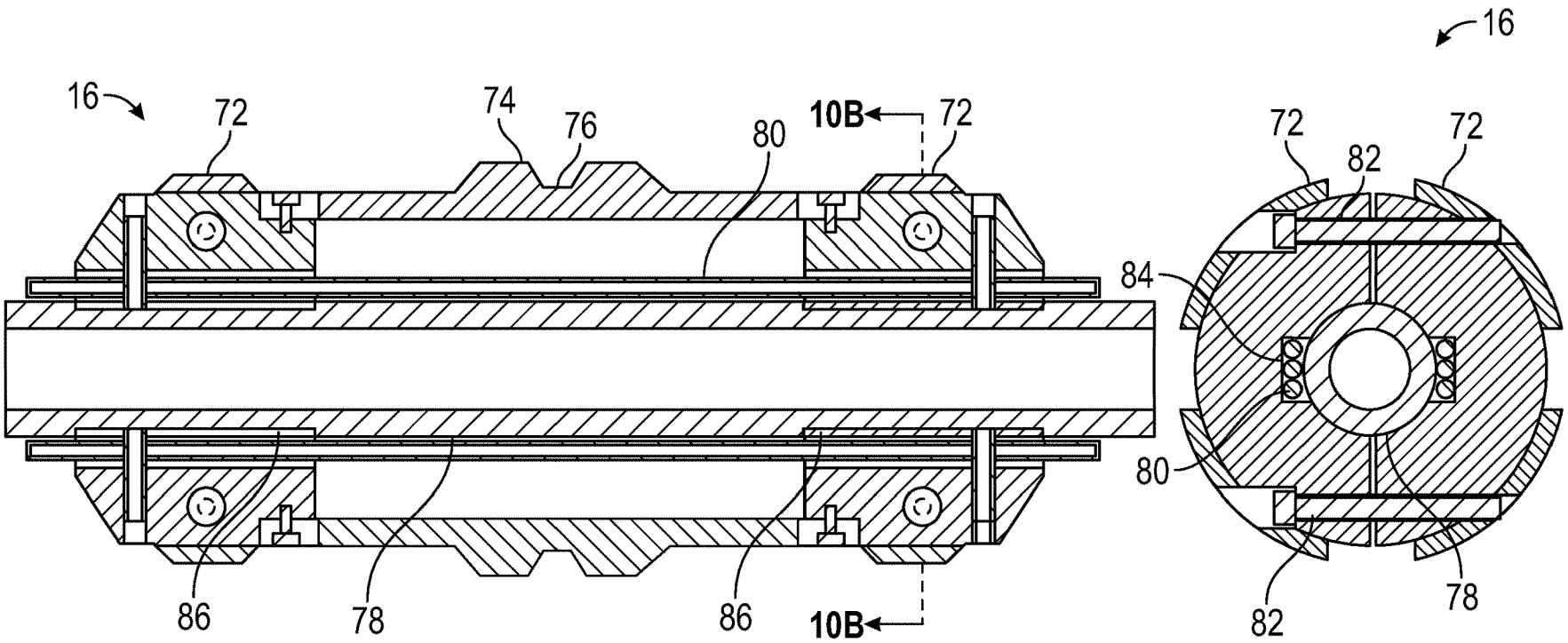
FIG. 10A is a partial cross-section of an example of a split shifting tool, according to an embodiment of the disclosure.
FIG. 10B is a top view of the example of the split shifting tool of FIG. 10A, taken along line 10B-10B, according to an embodiment of the disclosure.

Referring now to FIG. 10A, a partial cross-section of an alternate design of a split shifting tool 16 according to one or more embodiments of the present disclosure is shown. Specifically, FIG. 10A shows the split shifting tool 16 having the same components as described with respect to FIG. 7A above. In contrast to FIG. 7A, however, FIG. 10A also shows that the split shifting tool 16 may include at least one groove 86 for taking an axial load according to one or more embodiments of the present disclosure. FIG. 10B is a top view of the example of the split shifting tool 16 of FIG. 10A taken along line 10B-10B, according to one or more embodiments of the present disclosure. This view of FIG. 10B is similar to that of the view of FIG. 7B, as previously described.

Figure 11:
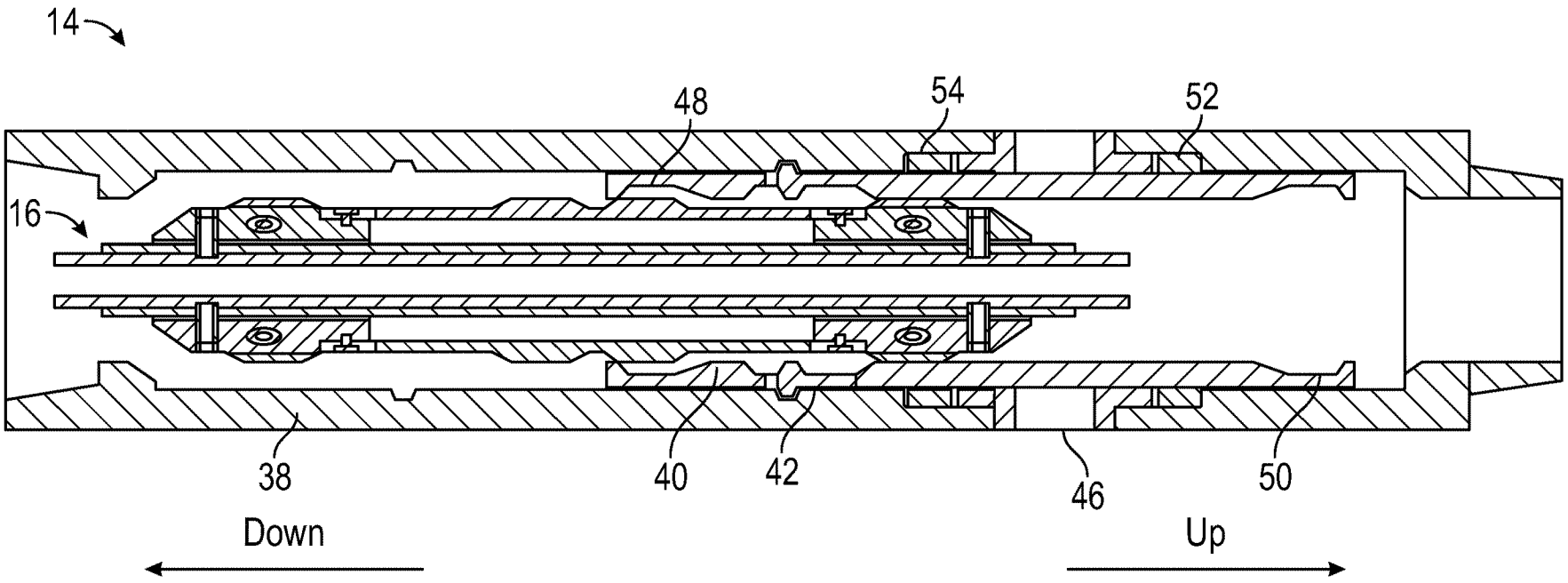
FIG. 11 is a schematic illustration of an example of a split shifting tool and a sliding sleeve valve, according to an embodiment of the disclosure.
Figure 12:
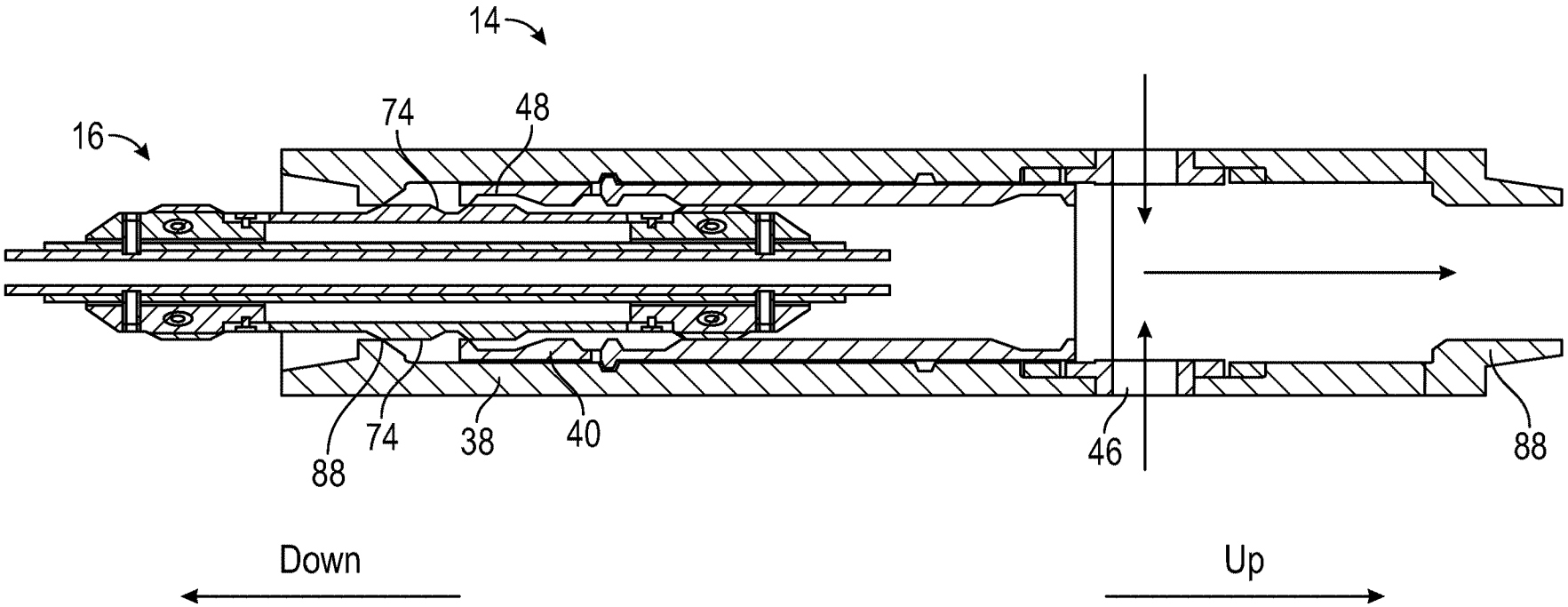
FIG. 12 is a schematic illustration similar to that of FIG. 11 but during a different operational stage, according to an embodiment of the disclosure.
Figure 13:
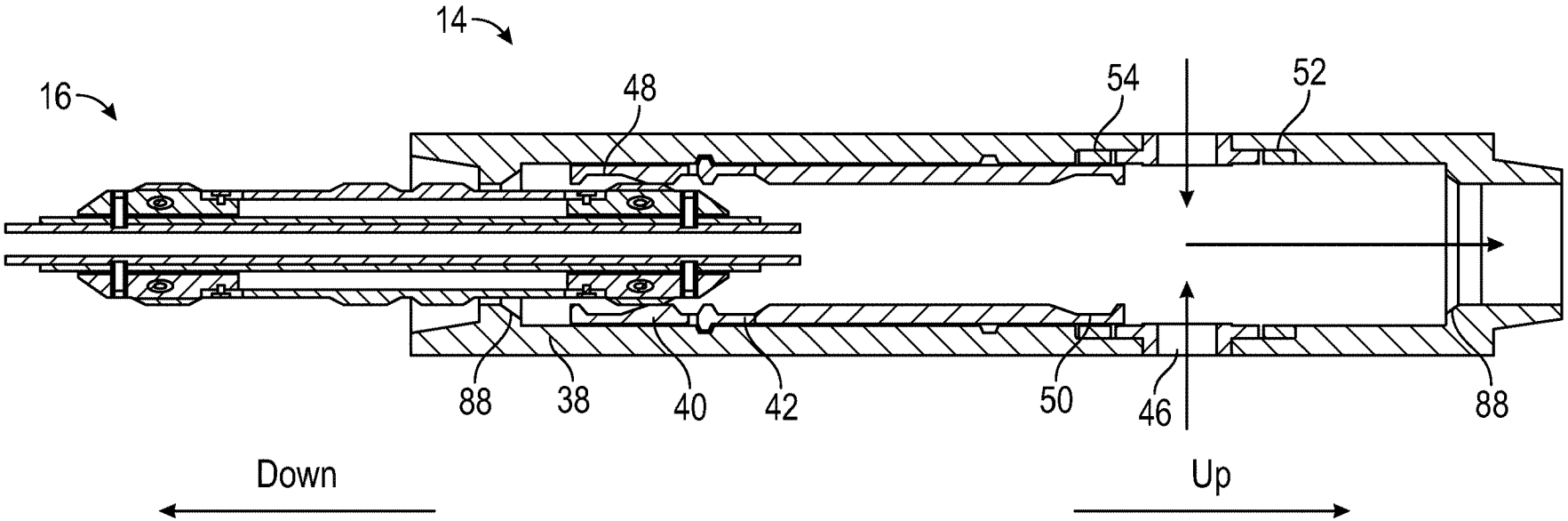
FIG. 13 is a schematic illustration similar to that of FIG. 12 but during a different operational stage, according to an embodiment of the disclosure.

Referring now to FIGS. 11-18, a method for operating a sliding sleeve valve 14 using a split shifting tool 16 according to one or more embodiments of the present disclosure is shown. As shown in FIG. 11, for example, sliding sleeve valve 14 is shown in a closed position. The split shifting tool 16 is run-in-hole until the opening selective profile 48 of the inner sleeve 40 of the sliding sleeve valve 14 engages the corresponding selective profile on the split shifting tool 16. According to one or more embodiments of the present disclosure, the split shifting tool 16 may be run via wireline, slickline, pump down procedures, rods, or via a conduit. Once the split shifting tool 16 engages with the inner sleeve 40 of the sliding sleeve valve 14 in this way, pushing down of the split shifting tool 16 also causes the inner sleeve 40 of the sliding sleeve valve 14 to shift downward until the flow ports 46 in the valve body 38 of the sliding sleeve valve 14 are uncovered as shown in FIG. 12, for example. That is, FIG. 12 shows the sliding sleeve valve 14 in the open position according to one or more embodiments of the present disclosure. As further shown in FIG. 12, as the split shifting tool 16, as engaged with the inner sleeve 40 of the sliding sleeve valve 14 is pushed further downhole, the housing shoulder 88 on the valve body 38 of the sliding sleeve valve 14 pushes the collet 74 of the split shifting tool 16 radially inward to allow the split shifting tool 16 to disengage from the opening selective profile 48 on the inner sleeve 40 of the sliding sleeve valve 14 (FIG. 13).

Figure 14:
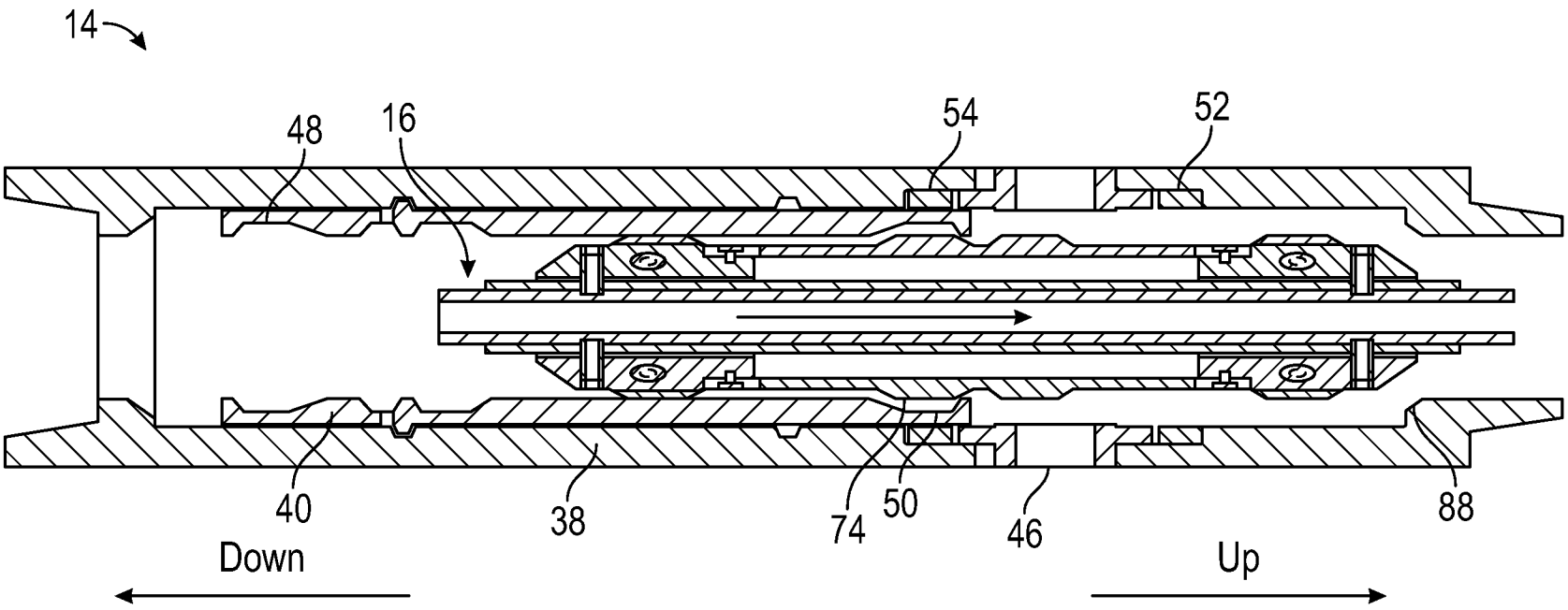
FIG. 14 is a schematic illustration similar to that of FIG. 13 but during a different operational stage, according to an embodiment of the disclosure.
Figure 15:
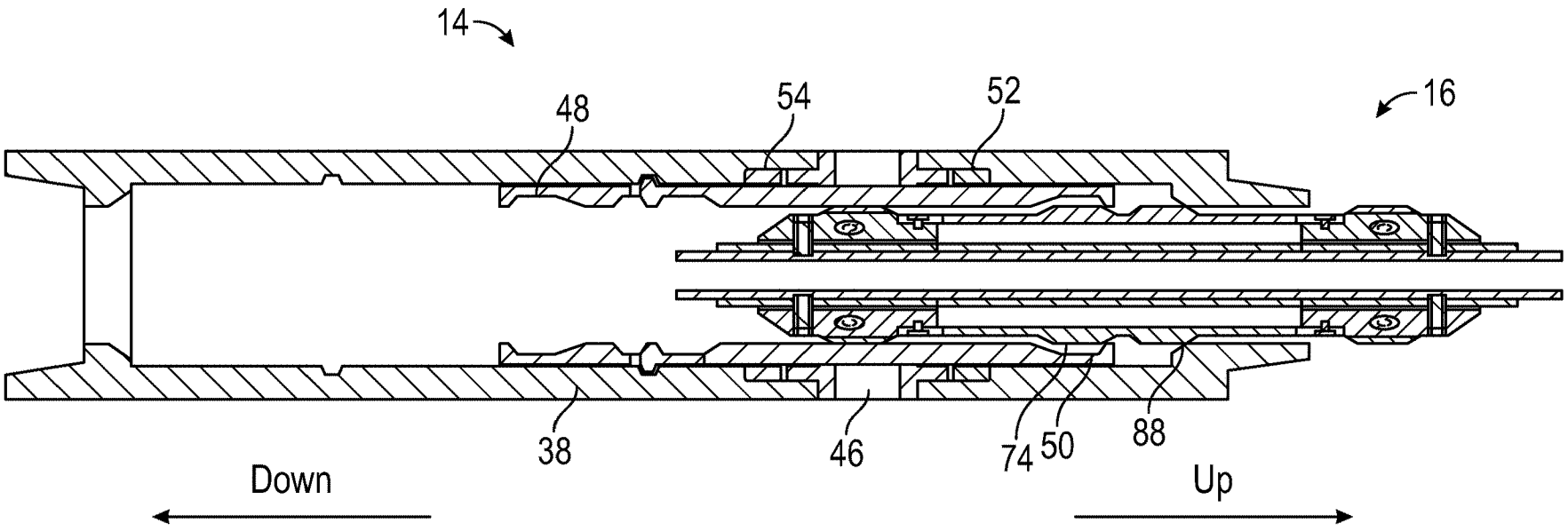
FIG. 15 is a schematic illustration similar to that of FIG. 14 but during a different operational stage, according to an embodiment of the disclosure.
Figure 16:
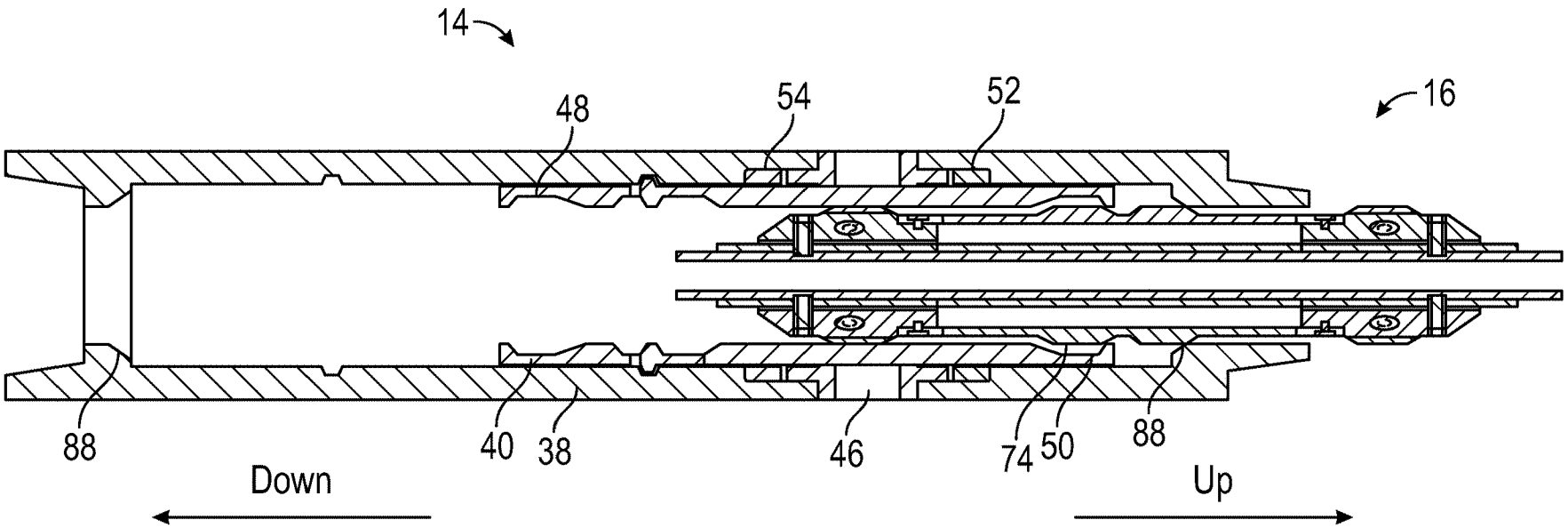
FIG. 16 is a schematic illustration similar to that of FIG. 15 but during a different operational stage, according to an embodiment of the disclosure.
Figure 17:
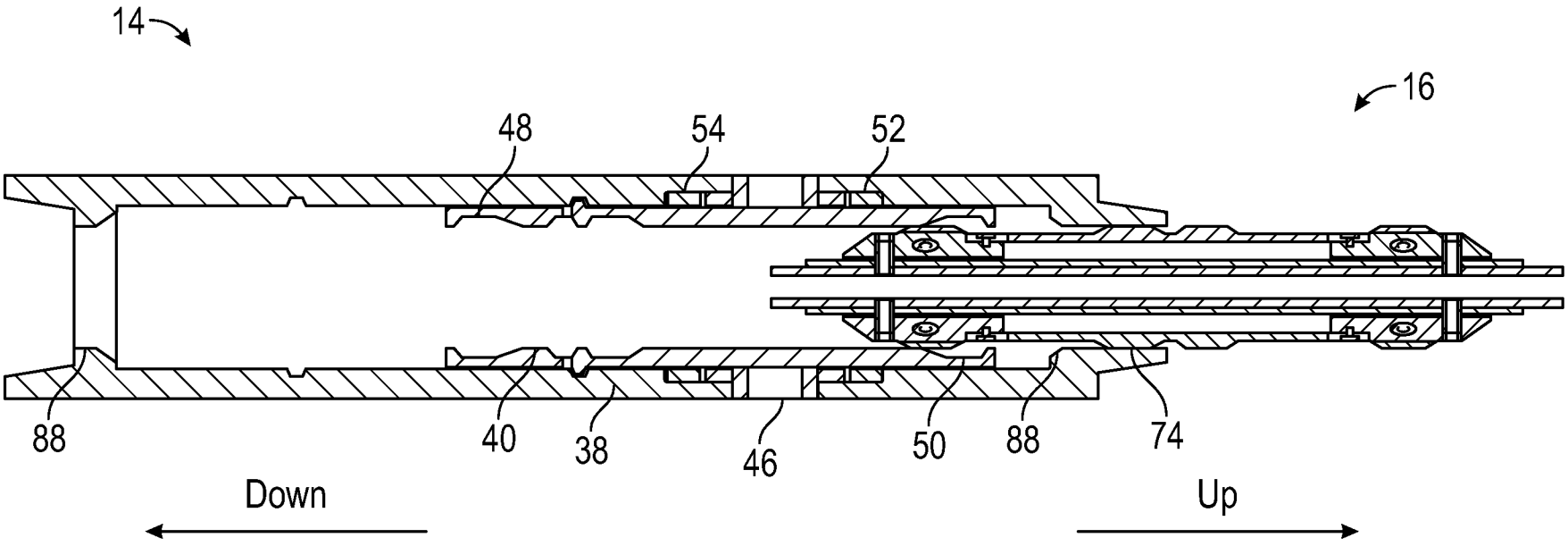
FIG. 17 is a schematic illustration similar to that of FIG. 16 but during a different operational stage, according to an embodiment of the disclosure.
Figure 18:
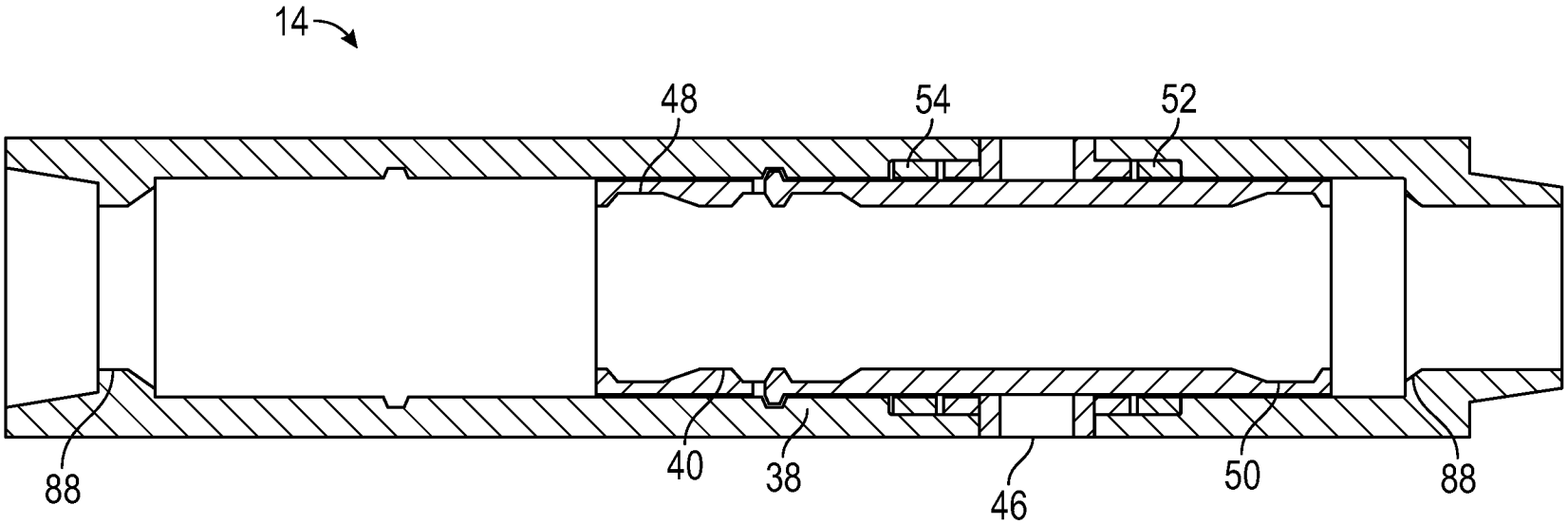
FIG. 18 is a schematic illustration similar to that of FIG. 17 but during a different operational stage, according to an embodiment of the disclosure.

Once the split shifting tool 16 has disengaged from the opening selective profile 48 on the inner sleeve 40 of the sliding sleeve valve 14, the split shifting tool 16 may be retrieved by pulling the split shifting tool 16 upward until a corresponding profile (e.g., the collet 74) on the split shifting tool 16 engages the closing selective profile 50 on the inner sleeve 40 of the sliding sleeve valve 14, as shown in FIG. 14. Engagement of the collet 74 on the split shifting tool 16 with the closing selective profile 50 on the inner sleeve 40 of the sliding sleeve valve 14 in this way allows the inner sleeve 40 of the sliding sleeve valve 14 to shift upward as the split shifting tool 16 is retrieved until the flow ports 46 in the valve body 38 of the sliding sleeve valve 14 are re-covered as shown in FIG. 15, for example. That is, FIG. 15 shows the sliding sleeve valve 14 in the closed position according to one or more embodiments of the present disclosure. As further shown in FIG. 16, as the split shifting tool 16, as engaged with the closing selective profile 50 on the inner sleeve 40 of the sliding sleeve valve 14, is pulled further uphole, the housing shoulder 88 on the valve body 38 of the sliding sleeve valve 14 pushes the collet 74 of the split shifting tool 16 radially inward to allow the split shifting tool 16 to disengage from the closing selective profile 50 on the inner sleeve 40 of the sliding sleeve valve 14 (FIG. 17). Once the split shifting tool 16 has disengaged from the closing selective profile 50 on the inner sleeve 40 of the sliding sleeve valve 14, the split shifting tool 16 may be retrieved (FIG. 17) by pulling the split shifting tool 16 upward until the split shifting tool has been completely removed from the wellbore, and the sliding sleeve valve 14 remains downhole in the closed position (FIG. 18).

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system comprising:

a sliding sleeve valve comprising a valve body and an inner sleeve selectively shiftable within the valve body, at least one flow port contained in the valve body;

at least one metal to metal seal provided between an inside wall of the valve body and the inner sleeve, wherein the inner sleeve comprises a plurality of selective profiles; and a shifting tool engageable with the plurality of selective profiles of the inner sleeve, wherein the shifting tool comprises a first half and a second half;

wherein the first half and the second half include a recess for accommodating a plurality of control lines;

wherein the first half and the second half are disposed around a tubing and fastened together, creating a central bore.

2. The system of claim 1, further comprising at least one non-elastomeric seal provided between the inside wall of the valve body and the inner sleeve.

3. The system of claim 1, further comprising:

a first non-elastomeric seal;

a second non-elastomeric seal; and a combination of a full support sleeve and a split ring provided between the metal to metal seal and the second non-elastomeric seal, wherein the first non-elastomeric seal, the second non-elastomeric seal, and the combination of the full support sleeve and the split ring are provided between the inside wall of the valve body and the inner sleeve.

4. The system of claim 3, further comprising:

a protector sleeve comprising a plurality of collets at a downhole end of the protector sleeve, wherein the inner sleeve comprises an uphole end having at least one protrusion, wherein the plurality of collets of the protector sleeve releasably hold the at least one protrusion of the inner sleeve when the sliding sleeve valve is in a closed position, and wherein the protector sleeve protects the at least one metal to metal seal, the combination of the full support sleeve and the split ring, and the second non-elastomeric seal when the sliding sleeve valve is in an open position.

5. The system of claim 1, further comprising:

a protector sleeve comprising a plurality of collets at a downhole end of the protector sleeve, wherein the inner sleeve comprises an uphole end having at least one protrusion, wherein the plurality of collets of the protector sleeve releasably hold the at least one protrusion of the inner sleeve when the sliding sleeve valve is in a closed position, and wherein the protector sleeve protects the at least one metal to metal seal when the sliding sleeve valve is in an open position.

6. A device, comprising:

a first half;

a second half, wherein the first half and the second half are disposed around a tubing and fastened together, creating a central bore;

wherein at least one of the first half and the second half includes a recess for accommodating a plurality of control lines; and at least one collet configured to engage a selective profile of an inner sleeve of a sliding sleeve valve.

7. The device of claim 6, wherein the first and second halves are fluted centralizers.

8. The device of claim 6, wherein the plurality of control lines is a control line flat pack.

9. The device of claim 6, wherein the first half and the second half each include at least one fastener attached to the tubing, wherein the at least one fastener is configured to prevent axial and rotational movement of the device with respect to the tubing.

10. The device of claim 6, further comprising a groove running parallel to the recess for bearing an axial load.

11. A method comprising:

running a sliding sleeve valve downhole in a closed position, wherein the sliding sleeve valve comprises:

a valve body;

an inner sleeve selectively shiftable within the valve body;

at least one flow port contained in the valve body; and at least one metal to metal seal provided between an inside wall of the valve body and the inner sleeve, wherein the inner sleeve comprises an opening selective profile and a closing selective profile;

operating a shifting tool to engage with the opening selective profile of the inner sleeve of the sliding sleeve valve, wherein the shifting tool comprises a first half and a second half; the first half and the second half include a recess for accommodating a plurality of control lines;

wherein the first half and the second half are disposed around a tubing and fastened together, creating a central bore;

shifting the inner sleeve of the sliding sleeve valve until the sliding sleeve valve transitions from the closed position to an open position in which the at least one flow port is uncovered;

disengaging the shifting tool from the opening selective profile of the inner sleeve of the sliding sleeve valve;

operating the shifting tool to engage with the closing selective profile of the inner sleeve of the sliding sleeve valve, shifting the inner sleeve of the sliding sleeve valve until the sliding sleeve valve transitions from the open position back to the closed position; and retrieving the shifting tool from downhole until the shifting tool disengages from the closing selective profile of the inner sleeve of the sliding sleeve valve.

* * * * *